US008225565B2

(12) United States Patent
Cox

(10) Patent No.: US 8,225,565 B2
(45) Date of Patent: Jul. 24, 2012

(54) INSULATED NATURAL LOG CABIN

(76) Inventor: Jesse Barton Cox, Fairview, NC (US)

( * ) Notice: Subject to any disclaimer, the term of this patent is extended or adjusted under 35 U.S.C. 154(b) by 0 days.

(21) Appl. No.: 13/208,134

(22) Filed: Aug. 11, 2011

(65) Prior Publication Data

US 2012/0031025 A1 Feb. 9, 2012

(51) Int. Cl.
*E04B 1/10* (2006.01)

(52) U.S. Cl. ..... 52/233; 52/271; 52/586.1; 52/223.4; 52/404.1

(58) Field of Classification Search ..... 52/586.1, 52/233, 286, 284, 301, 285.1, 698, 699, 700, 52/271, 592.6, 223.7, 404.1
See application file for complete search history.

(56) References Cited

U.S. PATENT DOCUMENTS 1,185,969 A * 6/1916 Blackstone ..... 52/293.2
1,499,483 A * 7/1924 Simms ..... 52/436
2,029,082 A * 1/1936 Odam ..... 52/275
2,392,551 A * 1/1946 Roe ..... 52/586.2
2,581,186 A * 1/1952 Green ..... 428/323
3,511,000 A * 5/1970 Keuls ..... 52/126.4
3,849,960 A * 11/1974 Henry et al. ..... 52/569
4,047,350 A * 9/1977 Chisum ..... 52/592.6
4,305,238 A * 12/1981 Harward et al. ..... 52/233
4,344,263 A * 8/1982 Farmont ..... 52/233
4,488,389 A * 12/1984 Farmont ..... 52/233
4,503,648 A * 3/1985 Mahaffey ..... 52/223.7
4,726,567 A * 2/1988 Greenberg ..... 256/19
4,742,657 A * 5/1988 Veech ..... 52/233
4,823,528 A * 4/1989 Faw ..... 52/233
5,020,289 A * 6/1991 Wrightman ..... 52/233
5,163,259 A * 11/1992 Hunsaker et al. ..... 52/233
5,253,458 A * 10/1993 Christian ..... 52/233
5,277,008 A * 1/1994 Saulez ..... 52/233
5,566,517 A * 10/1996 Ishii et al. ..... 52/387
5,577,357 A * 11/1996 Civelli ..... 52/233
5,787,675 A * 8/1998 Futagi ..... 52/745.1
5,890,332 A * 4/1999 Skidmore et al. ..... 52/271
6,543,193 B2 * 4/2003 Houseal ..... 52/233
6,588,161 B2 * 7/2003 Smith ..... 52/233
6,904,728 B2 * 6/2005 Stutts ..... 52/233
7,594,370 B2 * 9/2009 Clarke ..... 52/586.1
7,762,033 B2 * 7/2010 Scott et al. ..... 52/425
7,823,351 B2 * 11/2010 Tiberi et al. ..... 52/404.1

* cited by examiner

*Primary Examiner* — William Gilbert
*Assistant Examiner* — Chi Q Nguyen

(57) ABSTRACT

Interior insulation slots cut vertically through natural logs align to form a full wall interior insulation space within the stacked natural log wall. A plank cut out of the interior of each log is used in the interior structure of the building. Solid ends of the logs form corners with intersecting walls. Structural metal posts within the interior insulation space bind the logs together. Foam and vapor barrier insulation fill the interior insulation space. Only the curved natural log surfaces are exposed on the exterior and interior walls.

7 Claims, 3 Drawing Sheets

INSULATED NATURAL LOG CABIN

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to log cabin construction and in particular to a natural log cabin constructed with an interior insulation and structural support space formed by vertically aligned cut outs in each of the stacked logs wherein wiring and piping may be located as well as insulation and structural elements including a spaced vertical array of interior metal posts with threaded adjustment rods at each end to bind together all of the logs in a wall to insure structural integrity and to eliminate spaces between logs.

2. Description of Related Art Including Information Disclosed Under 37 CFR 1.97 and 1.98

Log cabins are part of the American tradition. The look and feel of houses built of whole logs has great appeal. Current trends in regulations for required insulation R values in building codes are making it necessary to provide added insulation to a log cabin to meet building code specifications in order to build the log cabin at all. Many prior art solutions to the insulation problem destroy the appearance of a natural log cabin and do not resemble the traditional log cabin with natural horizontally oriented logs stacked in vertical arrays to form the walls with the natural logs exposed on both the exterior and interior walls.

U.S. Pat. No. 4,344,263, issued Aug. 17, 1982 to Farmont, puts forth a wood log of substantial thickness and having flat top and bottom surfaces interrupted by complementary tongues and grooves along the length thereof. One or more slots open from at least one of the surfaces with the total slot depth extending over all but a small portion of the top to bottom thickness of the log. The slots are filled with an insulating material.

U.S. Pat. No. 3,992,838, issued Nov. 23, 1976 to Vizziello, concerns a building construction element in the form of an insulated wood log with flat planed upper and lower surfaces, a longitudinally extending groove being cut into each surface to a depth about half the thickness of the log, the grooves being on opposite sides of the vertical medial plane of the log, and each groove being filled with a foamed plastic mass having thermal insulating properties substantially equivalent to those of polyurethane plastics.

U.S. Pat. No. 4,318,257, issued Mar. 9, 1982 to Smith, provides a building structure made from wooden logs with gaps between the logs for receiving insulation. The gaps are formed between the stacked logs by driving sharpened spikes into oppositely facing logs so that the opposing sharpened tips of the spikes penetrate the logs and secure a fixed distance between such logs. Two spikes are normally aligned with one another and respectively driven near the inner and outer walls of the log structure. Each spike has a hole drilled there through for receiving a screw-like rod interconnecting the two spikes and supporting various building items such as a wire mesh screen for receiving plaster, a vapor barrier and inside panels. Furthermore, insulation is provided between the two logs so that the thermal resistance of the overall building structure is greater than a building structure which would use logs alone.

U.S. Pat. No. 5,687,520, issued Nov. 18, 1997 to Stranahan et al., shows a sealing system designed for use in buildings having log construction. The system makes use of horizontally-oriented channels that are located along the top and bottom face of each log. After the building has been assembled, vertically-oriented bores are drilled into each course of logs. The bore is located so that they interconnect a horizontal channel. Once the bore has been drilled, a liquid sealing material such as caulking is pumped into the bore where it then flows into and fills the horizontal channel.

U.S. Patent application #US20100043323A1, published Feb. 25, 2010 by Wrightman, shows a log for a log home having a plurality of pockets formed within the body of the log. The pockets are filled with foam to enhance the thermal rating of the log.

U.S. Pat. No. 2,309,426, issued Jan. 26, 1943 to Williams, describes a log type building structure have an outside stacked array of half rounded logs facing out and an inside stacked array of half rounded logs facing in, both attached to a support structure with a space between for insulation.

U.S. Pat. No. 7,823,351, issued Nov. 2, 2010 to Tiberi et al., indicates a stackable insulated unit for wall construction for forming a self-supporting wall structure consisting of two side wooden planks spaced apart and secured to one another with an intermediate insulating layer bonded thereto, and a plurality of stud longitudinal sections transversely extending through the insulating layer and being secured thereby. The insulating layer ensures structural integrity of the stackable unit. The stud sections are preferably spaced from at least one of the side planks. The invention also includes the method of fabrication of stackable unit.

U.S. Patent application #20080083177, published Apr. 10, 2008 by Tiberi et al., describes a stackable insulated unit for wall construction for forming a self-supporting wall structure consists of two side wooden planks spaced apart and secured to one another with an intermediate insulating layer bonded thereto, and a plurality of stud longitudinal sections transversely extending through the insulating layer and being secured thereby. The insulating layer ensures structural integrity of the stackable unit. The stud sections are preferably spaced from at least one of the side planks. The invention also includes the method of fabrication of stackable unit.

U.S. Pat. No. 4,147,000, issued Apr. 3, 1979 to Lewandowski, claims an insulated log building structure comprising two parallel, vertically extending log walls having an insulative layer of foam plastic disposed therebetween. Each of the walls are formed of horizontally extending logs mounted vertically upon one another in a tongue and groove relationship. A layer of fiberglass insulation may be disposed between the tongues and grooves of contacting logs to insulatively seal the joints. Vertically extending tie rods within vertically aligned apertures of the logs making up the walls hold the two log walls in parallel alignment.

U.S. Pat. No. 5,577,357, issued Nov. 26, 1996 to Civelli, discloses a system of and manner for applying half log siding to a pre-constructed wall with the use of a separate piece of interlocking material. Having a specific shape, this interlocking piece allows for easy assembly and will securely hold the bottoms and tops of the positioned half logs to the wall. This assembly is repeated up the wall until the desired amount of wall is covered with the siding. This separate interlocking piece is capable of being fastened to a wall constructed of any building material while remaining hidden within the completed assembly. The final appearance of the siding gives the illusion of full logs, the drawbacks related with their construction and settling is not experienced.

What is needed is a natural log cabin built of natural logs with the interior of the logs being insulated and the insulation not visible so that only the natural logs are exposed on the exterior and interior walls, yet the building requirement insulation values are met.

BRIEF SUMMARY OF THE INVENTION

An object of the present invention is to provide a natural log cabin built of natural logs with a plank cut out of the interior of each log creating an elongated insulation slot from the top of the log to the bottom of the log extending along the length of the log with approximately four feet of solid uncut log at each end, the horizontally oriented logs stacked in a vertical array aligning the insulation slots to form a full wall interior insulation space, and structural metal posts inserted vertically in a spaced array within the interior insulation space through all of the logs with the posts attached to each of the logs, and insulation filling the interior insulation space, so that the logs are insulated to meet or exceed insulation requirements and the insulation is not visible and only the natural logs are exposed on the exterior and interior walls.

Another object of the present invention is to provide top and bottom end adjustments on the posts so that the top log and bottom log can be drawn together to bind all the logs together in the wall and eliminate any open space between the stacked logs.

An added object of the present invention is to provide a foil vapor barrier within the aligned elongated spaces to provide a reflective value.

One more object of the present invention is to utilize the plank cut out of each log in the log cabin for flooring, roofing, or other uses.

In brief, a natural log cabin constructed with an interior insulation and structural support space formed by vertically aligned insulation slots cut out of each of the stacked logs wherein wiring and piping may be located as well as insulation and structural elements including a spaced vertical array of interior metal posts with threaded adjustment rods at each end to bind together all of the logs in a wall to insure structural integrity and to eliminate spaces between logs. The logs may be milled at a mill and the logs having the insulation slots and cut out planks shipped to a building site or the whole logs shipped to the building site and the insulation slot cut on the building site. The insulation slots are cut preferably with a modified band saw and/or a chainsaw.

An advantage of the present invention is that it provides a natural log building which is fully insulated in the interior of the natural log wall to meet building code standards for R value.

BRIEF DESCRIPTION OF THE SEVERAL VIEWS OF THE DRAWINGS

These and other details of the present invention will be described in connection with the accompanying drawings, which are furnished only by way of illustration and not in limitation of the invention, and in which drawings.

DETAILED DESCRIPTION OF THE INVENTION

Figure 1:
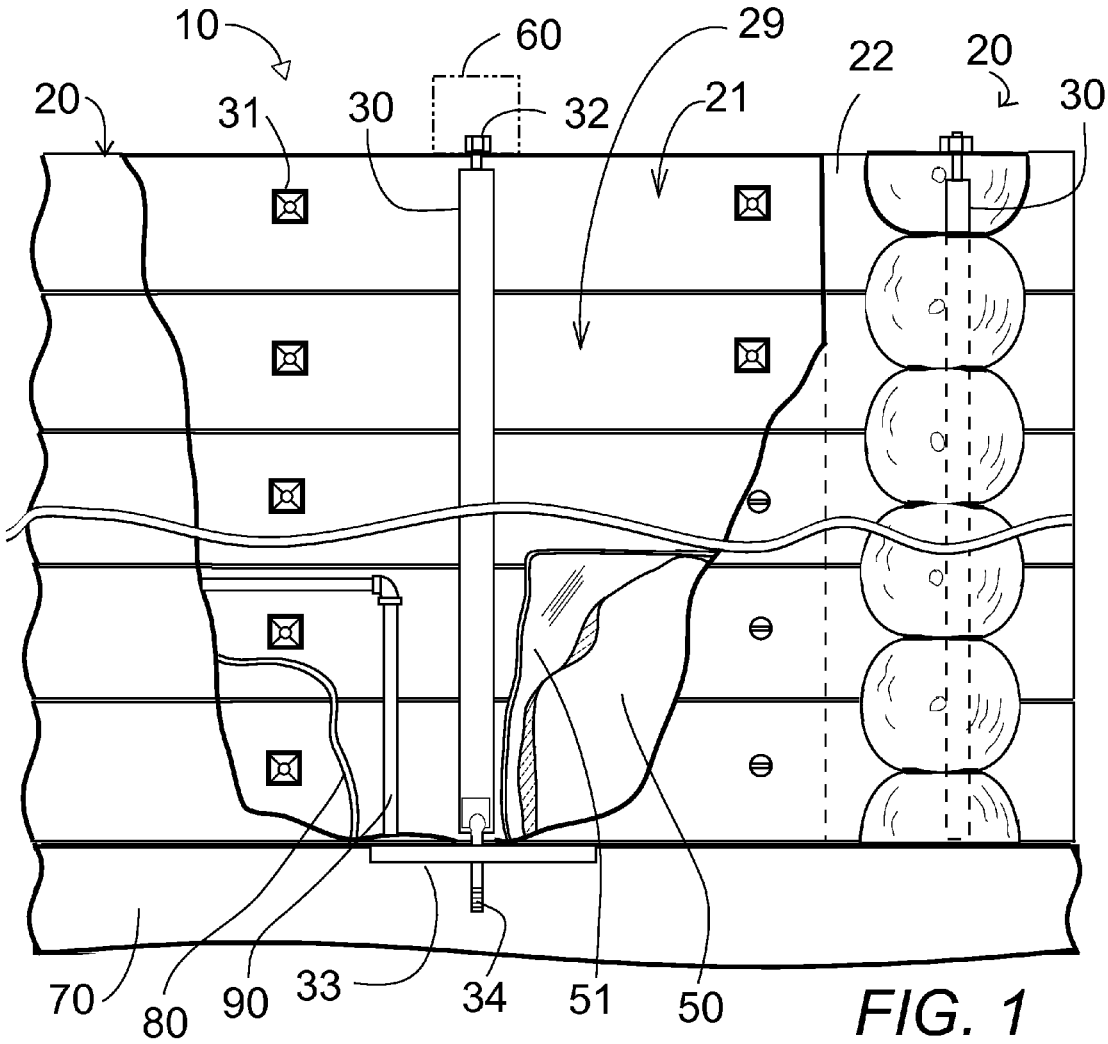
FIG. 1 is an elevational view in partial section of the insulated natural log cabin structure of the present invention showing a portion of a wall and a corner of the insulated natural log cabin.

In FIGS. 1-4, an insulation system 10 for a natural log cabin comprises a plurality of natural logs 20, each positioned horizontally in a vertical array of single natural logs stacked one on top of another to form a wall, as shown in FIG. 1. Each of the natural logs 20 has a flat top log contacting surface 27 and a flat bottom log contacting surface 28 for contacting adjacent top and bottom logs with the curved sides of the natural logs exposed. Each of the natural logs 20 has an elongated insulation slot 21 cut through the natural log from the top log contacting surface 27 to the bottom log contacting surface 28 and extending along a substantial portion of the length of the natural log leaving a solid log end portion 22 at each end of the natural log to maintain the structural integrity of the natural log and to form a corner joint with a similar orthogonal wall of natural logs, as shown in FIG. 1. The solid ends are each approximately four feet in length or whatever length is required for integrating into a corner with an adjacent wall.

Figure 2:
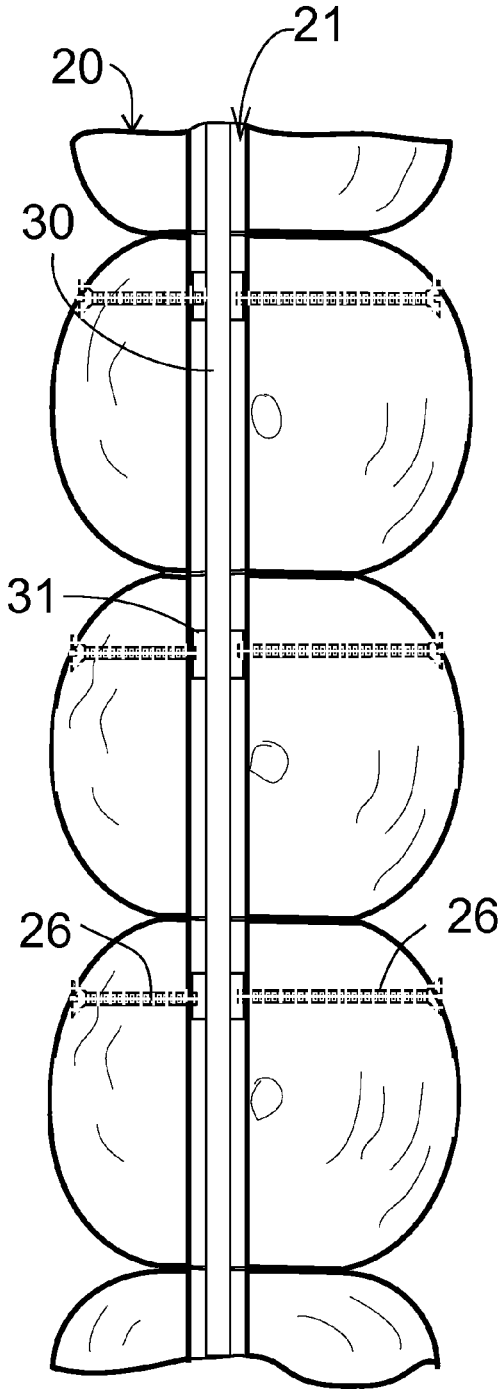
FIG. 2 is a cross sectional view taken through a wall of the insulated natural log cabin structure of the present invention showing the inner insulation and support structure space.
Figure 3:
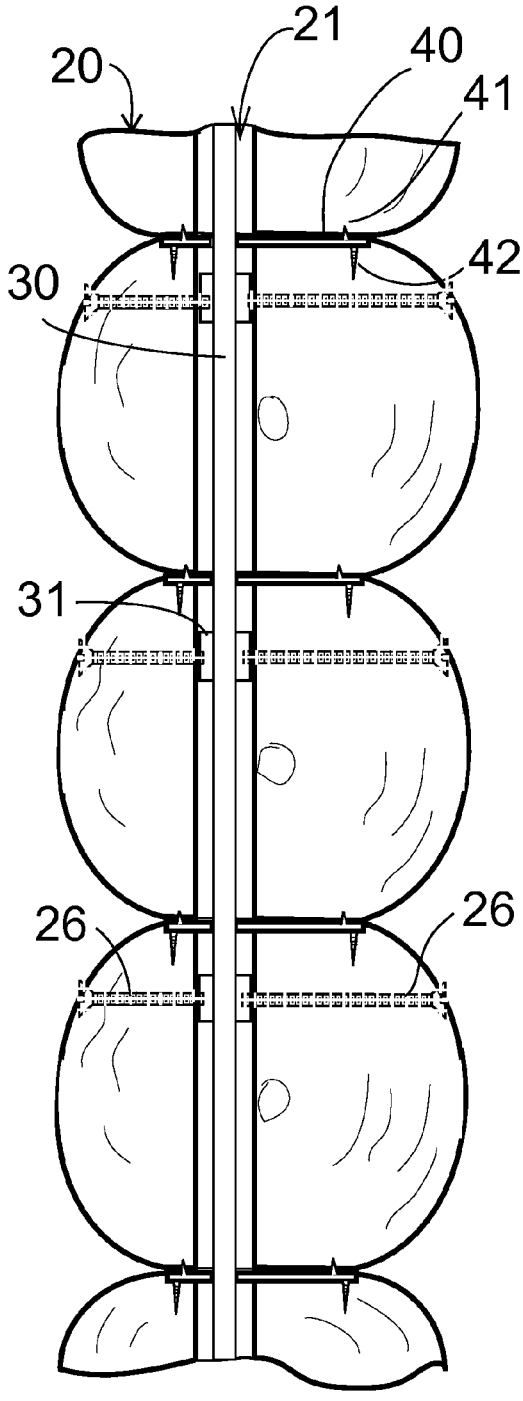
FIG. 3 is a cross sectional view taken through a wall of the insulated natural log cabin structure of the present invention showing the inner insulation and support structure space and the horizontal cross plates between the stacked logs.

In FIG. 1, the insulation slots 21 align in the vertical stack of logs to create an interior insulation space 29 from a top of the wall to a bottom of the wall to receive wiring 80, plumbing 90, and insulation, such as foam insulation 50 sprayed in as the logs are stacked up and foil insulation 51 as a vapor barrier and reflector. The insulation space 29 formed by the aligned insulation slots 21 in each log 20 is preferably closer to an exterior wall, as shown in FIGS. 2 and 3, to leave a larger log area on the inside wall for retained heat. The natural log cabin walls with the invisible interior insulation space meets or exceeds insulation requirements. The insulation is not visible and only the curved sides of the natural logs exposed on the exterior and interior of the wall.

In FIG. 1, a series of spaced vertical structural posts 30, preferably structural metal posts, are inserted vertically in the interior insulation space 29. Each has a top means 32 for adjustably attaching a top end of each of the structural posts or to a roof beam 60 to a top natural log in the wall and a bottom means, such as a threaded bolt 34 screwed into a bottom plate 33 and imbedded in a concrete foundation 70 for adjustably attaching a bottom end of each of the structural posts 30 to the bottom foundation so that the structural posts 30 adjust at the ends to bind the natural logs 20 of the wall together to provide structural integrity to the wall and to eliminate any spaces between adjacent logs.

Figure 4:
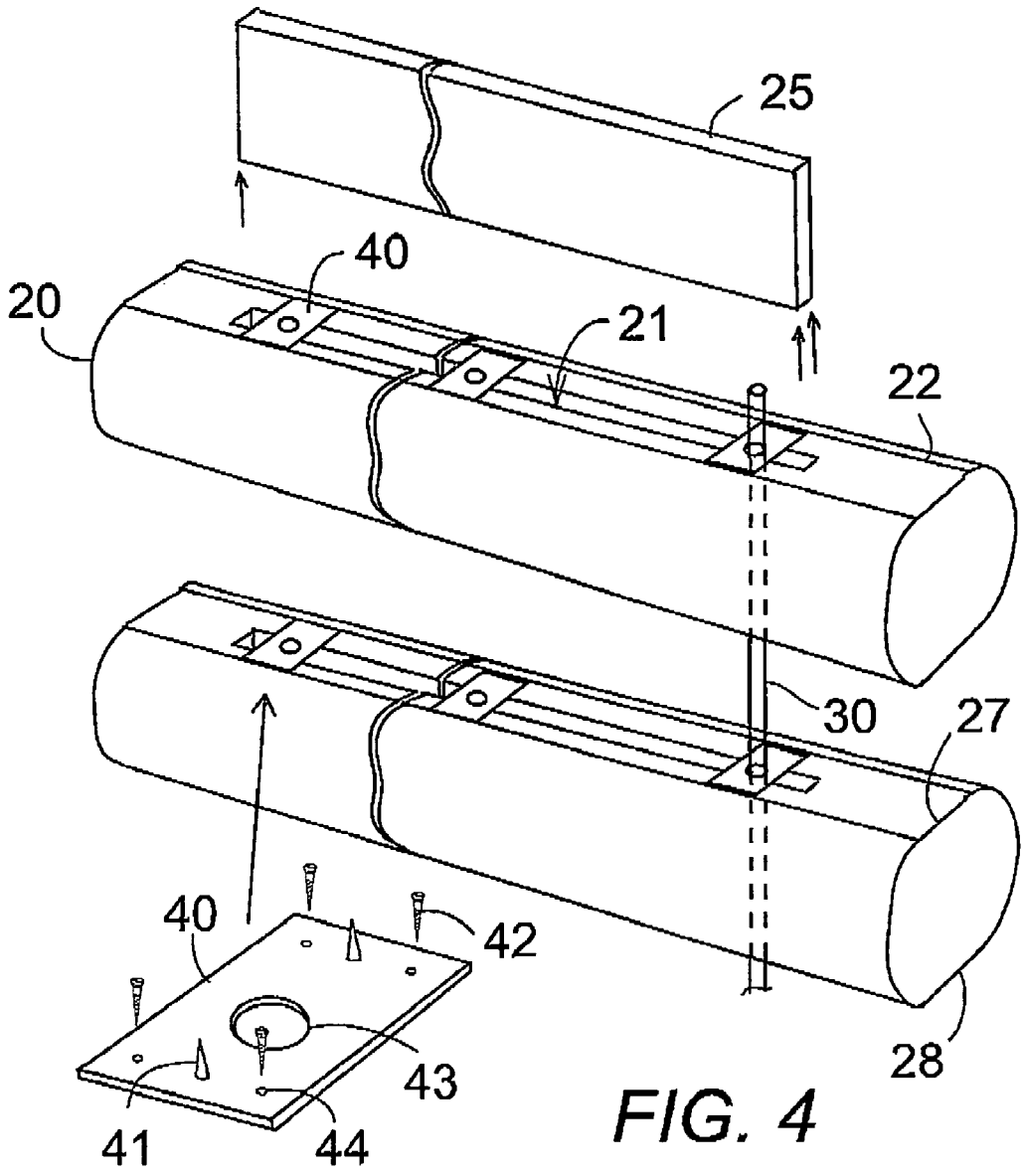
FIG. 4 is a partial perspective view of a pair of logs of the present invention showing the inner insulation and support structure space and a board cut from the top log to produce the inner space and the horizontal cross plates between the stacked logs and a vertical support post held by the cross plates.

In FIG. 4, a plank 25 is preferably cut out of each of the natural logs 20 to form the elongated insulation slot 21 so that the plank can be used in the log cabin construction as part of a roof, floor, or interior wall structure. The plank 25 may have a thickness approximately four inches thick, leaving a four inch wide insulation slot 21, and may have a width equal to the diameter of the log, which may be twelve inches, and may have a length equal to the length of the log minus about eight feet due to the four feet solid ends of the log.

In FIGS. 2 and 3, a series of inner wall spacers 31 contact both inner walls throughout the interior insulation space 29. Each of the inner wall spacers comprising a rigid framework spanning the interior insulation space and each of the inner wall spacers having a threaded opening facing each of the inner walls to receive a threaded fastener 26 from an outside natural log face and an inside natural log face to stabilize the natural logs and maintain a constant size of the interior insulation space.

In FIGS. 3 and 4, a series of horizontal cross plates 40 are installed in a spaced array along the top log contacting surface 27 in recessed notches. Each of the cross plates 40 spans the insulation opening and runs the width of the top log contacting surface 27. Each of the cross plates 40 preferably comprises a rigid planar plate having a post opening 43 therethrough positioned in the interior insulation space 29 to support a vertical support post 30 therein and a plurality of fastener holes 44 therein to receive wood screws 42 into a lower log and at least one upwardly protruding spike 41 to stick into a bottom of an upper log installed over the lower log to secure the logs together.

The logs may be milled at a mill and the logs having the insulation slots and cut out planks shipped to a building site or the whole logs shipped to the building site and the insulation slot cut on the building site. The insulation slots are cut preferably with a modified band saw and/or a chainsaw.

In use, the top log contacting surface 27 and bottom log contacting surface 28 are formed on the natural logs 20 and the planks 40 are cut from the logs to form the insulations slots 21 which align when the logs are stacked to form the full wall interior insulation space 29. The inner wall spacers 31 are installed with the threaded fasteners 26 screwed in from each side. The horizontal cross plates 40 are secured by the wood screws 42 along the length of the top log contacting surface 27. The posts 30 are attached to the foundation 70 and the logs 20 are stacked to form the wall with wiring 80, plumbing 90, foil insulation 51, and foam insulation 50 installed as the logs are built up. The adjustable top means 32 is tightened to bind the stacked logs 20 together.

It is understood that the preceding description is given merely by way of illustration and not in limitation of the invention and that various modifications may be made thereto without departing from the spirit of the invention as claimed.

What is claimed is:

1. An insulation system for a natural log cabin, the system comprising:

a plurality of natural logs each positioned horizontally in a vertical array of single natural logs stacked one on top of another to form a wall, each of the natural logs having a top log contacting surface and a bottom log contacting surface for contacting adjacent top and bottom logs with the sides of the natural logs exposed, each of the natural logs having an elongated insulation slot cut through the natural log from the top log contacting surface to the bottom log contacting surface and extending along a substantial portion of the length of the natural log leaving a solid log end portion at each end of the natural log to maintain the structural integrity of the natural log and to form a corner joint with a similar orthogonal wall of natural logs, the insulation slot of each natural log aligning with the insulation slot of each adjacent natural log to form a vertically aligned array of insulation slots aligned in the vertical stack of logs to create a full wall interior insulation space to receive wiring, plumbing, and insulation in the interior insulation space to form an insulation system for a natural log cabin having the interior insulation space sufficiently thick to be filled with a sufficient thickness of insulation to meet or exceed insulation requirements, the insulation not being visible and only the sides of the natural logs exposed on the exterior and interior of the wall;

a series of spaced vertical structural posts inserted vertically in the interior insulation space; a first means for adjustably attaching a top end of each of the structural posts to a top natural log in the wall and a second means for adjustably attaching a bottom end of each of the structural posts to a bottom foundation so that the structural posts adjust at the ends to bind the logs of the wall together to provide structural integrity to the wall and to eliminate any spaces between adjacent logs;

a series of horizontal cross plates installed in a spaced array along the top log contacting surface in recessed notches, each of the cross plates spanning the insulation opening, each of the cross plates comprising a rigid planar plate having a post opening therethrough positioned in the interior insulation space to support one of the vertical support posts therein and a plurality of fastener holes therein to receive wood screws into a lower log and at least one upwardly protruding spike to stick into a bottom of an upper log installed over the lower log to secure the logs together.

2. The system of claim 1 further comprising a plank cut out of each of the natural logs to form the elongated insulation slot, the plank being used in the log cabin construction.

3. The system of claim 1 wherein the structural posts each comprise a structural metal post and the means for adjustably attaching the ends of the posts comprise a first metal threaded shaft extending out of a top end and a second metal shaft connecting to a bottom end of the structural metal post.

4. The system of claim 1 further comprising a series of inner wall spacers contacting both inner walls throughout the interior insulation space, each of the inner wall spacers comprising a rigid framework spanning the interior insulation space and each of the inner wall spacers having a threaded opening facing each of the inner walls to receive a threaded fastener from an outside natural log face and an inside natural log face to stabilize the natural logs and maintain a constant size of the interior insulation space.

5. The system of claim 1 wherein each solid log end portion extends four feet from the insulation slot to the end of the log.

6. The system of claim 1 wherein the logs having the insulation slots comprise natural logs milled at a mill and shipped to a building site along with the cut out planks.

7. The system of claim 1 wherein the logs having the insulation slots comprise natural logs shipped to a building site, the insulation slot cut on the building site.

* * * * *